United States Patent [19]

Gundlach et al.

[11] 4,063,051

[45] Dec. 13, 1977

[54] APPARATUS FOR DETECTING BUMPS IN A WEB

[75] Inventors: Robert W. Gundlach, Victor; Frederick W. Hudson, West Henrietta, both of N.Y.

[73] Assignee: Standard Products Corporation, New Rochelle, N.Y.

[21] Appl. No.: 683,068

[22] Filed: May 4, 1976

[51] Int. Cl.[2] ..... B65H 25/14

[52] U.S. Cl. ..... 200/61.13; 340/259

[58] Field of Search ..... 28/51; 73/159; 66/163; 200/61.13, 61.14, 61.18, 52 R, 61.41, 61.42; 192/125 R, 126, 127; 340/259; 242/28, 57

[56] References Cited

U.S. PATENT DOCUMENTS

| | | | |
|---|---|---|---|
| 869,324 | 10/1907 | Obert | 340/259 |
| 1,139,839 | 5/1915 | Bottinelli | 200/61.13 |
| 2,444,170 | 6/1948 | Sabel | 200/61.13 X |
| 3,037,381 | 6/1962 | Grant et al. | 340/259 X |
| 3,151,482 | 10/1964 | Forrester et al. | 73/159 |
| 3,301,974 | 1/1967 | Hancock | 200/61.42 X |
| 3,371,331 | 2/1968 | Buckholz | 340/259 |
| 3,500,437 | 3/1970 | Foerster | 73/159 X |
| 3,553,668 | 1/1971 | Urmenyi | 200/61.13 X |
| 3,842,668 | 10/1974 | Lippke | 200/61.13 X |

*Primary Examiner*—James R. Scott
*Attorney, Agent, or Firm*—Henry R. Lerner

[57] ABSTRACT

Apparatus for detecting bumps in a web, such as are caused by double threads or knots in a web of fabric, as the web is advanced past the detecting apparatus, comprises a blade, preferably a plurality of partially overlapping blades, arranged across the web and riding on the web. Each blade comprises one element of a switch the other element of which is constituted of a contact member arranged above the blade a distance from the blade greater than the height of the bumps to be detected. The blade is sufficiently light and so mounted that when it is struck by a bump on the web, it bounces out of engagement with the web and contacts the contact member thus closing the switch which is in an electrical circuit. A deactuatable means for moving the web is operatively associated with the switch whereby closing of the switch deactuates said web moving means. A marking means for marking the web when the switch is closed may also be operatively associated with the switch. Similarly, an audible signal may be operatively associated with the switch.

16 Claims, 8 Drawing Figures

APPARATUS FOR DETECTING BUMPS IN A WEB

BACKGROUND OF THE INVENTION

This invention relates to apparatus for detecting flaws in a web. More particularly, the flaws to be detected are bumps. In preferred embodiments of the invention, the web is a fabric and the bumps are flaws caused by double threads, knots and the like in the fabric.

It is essential that certain webs be free of flaws. For example, when the web is a fabric, it may be critical that the fabric be free of flaws. This is so, for instance, when the fabric is to be inked and cut into strips or ribbons for use in typwriters or computer print-outs. Bumps in such a fabric are unacceptable and such a flaw in the fabric must be eliminated or the portion of fabric containing the flaw discarded. The bumps are caused by double threads, knots and the like. In the past, such flaws have generally been detected by means of the human eye by passing the fabric over a brightly back-illuminated translucent screen while the fabric is closely observed by an inspector. When the inspector observes a flaw in the fabric, he marks the edge or selvage of the fabric on a transverse line with the flaw. Either the flaw is worked out of the fabric or the portion of fabric containing the flaw is discarded. Such an operation is time-consuming and costly in terms of manpower.

An alternative is electronic optical scanning systems which are, however, relatively costly. As other alternatives, various essentially mechanical devices have been proposed in the prior art. U.S. Pat. No. 869,324 discloses an apparatus which detects bumps in a web by having a bar or blade in engagement with the moving web so that upon occurrence of a bump, the bar or blade is displaced, causing an arm to engage a contact and thereby close a switch which stops the operation of the machine. At the same time, there is formed a tear in the web to indicate the location of the imperfection. However, the single bar or blade disclosed in this patent is relatively heavy and is adapted to be in contact at all times with the web, which in the specific embodiment of this patent is disclosed to be a paper. This device is unsuitable for detecting bumps on a soft, compressible web, which bumps are less than the average thickness of the web because it tends to compress the bumps rather than react thereto. This is the case, for example, when bumps are to be detected on the aforementioned fine fabrics which are used for typewriter ribbons, computer print-out inked fabric webs and the like.

U.S. Pat. No. 3,037,381 also deals with a bump detector of a mechanical type. Here, a plurality of blades are arranged side by side, transversely of the moving web, so that when a bump moves past a blade, the latter is displaced to produce an appropriate signal. More particularly, the blades or skids are spring supported by more massive, axially hinged blocks and the flexing of the spring due to web thickness changes is monitored by a phonograph pick-up signal generator. The photograph pick-up adds to the cost of this equipment. As in the aforementioned prior art mechanical apparatus, the skids continuously ride on the fabric. Hence, one must contend with the "noise" generated by normal, acceptable unevenness in the surface of the fabric not sufficient to close the switch. Moreover, the skids do not have the necessary degrees of freedom to seat themselves with uniform pressure along their length.

U.S. Pat. No. 3,151,482 similarly discloses an apparatus having a plurality of blades, in various forms or arrangements, which are displaceable by a bump to produce an appropriate signal for detecting the bump and making an appropriate marking for locating the bump. Here, the signal is generated by changes in the capacitive coupling of the conducting blades or skids to a conductive roller. "Noise" would be a problem in this system, too.

SUMMARY OF THE INVENTION

It is an object of the present invention to provide an apparatus for detecting bumps in a web, which apparatus is generally simpler, more reliable, more sensitive and more economical as well as more suitable for detecting bumps in a soft compressible web, particularly small bumps, for example bumps smaller than and thickness of the web as compared with the bumps detecting apparatus of the prior art.

Other objects and advantages of the invention will be apparent to one skilled in the art from the following description of the invention.

In general terms, there is provided in the present invention an improved apparatus of the type employing blades for detecting bumps in a web. Unlike the prior art, the blade is of such relatively low weight and so mounted that when it is struck by a bump, the impact causes the blade to lose contact with the web. A contact member, which functions with the blade as a switch, is mounted above the blade a distance such that when the blade strikes a bump and, consequently, bounces off the web, the blade contacts the contact member and, thereby, alters the condition of an electrical circuit for which the blade and contact member together define a switch. Generally, the circuit which is closed by the closing of the switch, whereby current flows through the circuit, is associated with means for deactuating the means which drive the web past the bump detector, means for marking the edge of the web in line with the bump for indicating the location of the bump and means for actuating an audible signal for each bump to inform the operator. Of course, which of these means or the particular combination thereof which is employed is optional.

The apparatus is so designed that normal, acceptable irregularities on the surface of the web do not cause the blade to bounce and make contact with the contact member. Consequently, there is no "noise", or, in other words, an infinite signal to "noise" ratio. On the other hand, the blade does not bear on the web with sufficient force to compress rather than to react to bumps which are to be detected.

It is unique in the bump detector of the present invention that the contact member is supported a distance above the sensing member, that is, the blade, greater than the height of the bumps to be detected. For example, typically, 2 mil bumps may be detected by having the contact member arranged about 15 mils above the upper extremity of the blade when the blade is in contact with a flaw-free portion of the web. When the web is a fabric for typewriter ribbon and the like, the nominal thickness of the web is generally in the range of 2 to 5 mils. It will be understood, however, that these particular figures are not limitations on the scope of the invention.

It is a requirement of the invention that the bump deflect the blade rather than the blade compress and ride over the bump. Since the impact of the bump with the blade must be sufficient to cause the blade to bounce, it has been found that most reliable operation is obtained when the speed of the web relative to the blades is at least about 50 feet per minute. Typically, the apparatus is operated with the web moving relative to the blades at a speed in the range of about 50 to about 300 feet per minute.

While, in principle, the invention is applicable to the use of a single sensing member, such as a blade, it is generally preferred, particularly when the web is of substantial width, that a plurality of relatively small sensing members or blades be used in order to satisfy the requirement of the invention that the sensing member or blade be relatively low in mass.

In a specific, preferred embodiment of the invention, each of the sensing members is a blade and the blades are each supported by the combination of a respective cylindrical bearing the axis of which bearing is arranged parallel to the edge of the blade which edge engages the web and a respective arm one end of which is rigidly connected to the blade intermediate the ends of the blade, preferably about halfway between the ends of the blade, and the other end of which is so supported by the cylindrical bearing that the arm is free to move in a plane which plane is substantially normal to the plane of the web and which plane also is substantially parallel to the direction of movement of the web, whereby the blade is free to bounce in response to engagement with a bump in the web. More specifically, the other end of the arm is hooked partially around the shaft with sufficient clearance to permit the arm to move slightly about an axis parallel to the axis of the arm whereby the edge of the blade will seat itself on the web even when the line of contact of the edge of the blade with the surface of the web is not in a plane absolutely parallel to the axis of the shaft.

When a plurality of blades is employed, the blades will preferably be arranged so that the lateral extremities of each overlap slightly the adjacent lateral extremity of each adjacent blade. In this way, detection across the entire width of the web is assured. In this case, while the clearance between the arm and the bearing is still sufficient to permit the arm to move slightly about its axis, whereby the edge of the blade will seat itself on the web even when the line of contact of the edge of the blade with the surface of the web is not in a plane absolutely parallel to the axis of the shaft, such clearance is not sufficient to permit the arm to move about an axis normal to the plane of the web to an extent sufficient to cause the blade connected to the arm to contact a next adjacent blade.

In a preferred construction, the contact member comprises an externally threaded post supported by a fixed member having an internally threaded bore engaging the threads on the post whereby the post is axially adjustable by turning the post in the bore. Suppose, for example, that the number of threads is about 33 per inch and that it is desired to have the lower extremity of the post spaced about 15 mils above the upper extremity of the blade when the blade is in contact with a flaw-free portion of the web. Under these conditions the blade is rested on said flaw-free portion, the post is twisted clockwise until it makes contact with the upper extremity of the blade, as indicated, for example, by the sounding of the audible signal, and, finally, the post is twisted back, counterclockwise about one half turn, which, thus, provides the desired clearance of about 15 mils.

When an audible signal means is employed in accordance with a preferred embodiment of the invention, the means is adapted for emitting a discrete audible signal for each closing of a switch, that is, contacting of a blade with a contact member, even when a plurality of switches are closed at the same time, whereby an operator of the apparatus is informed of the presence of a plurality of defects along the same transverse line on the web.

DESCRIPTION OF A PREFERRED EMBODIMENT

The invention will now be further described by reference to a preferred embodiment, as illustrated in the drawings, in which.

Figures 1, 5:
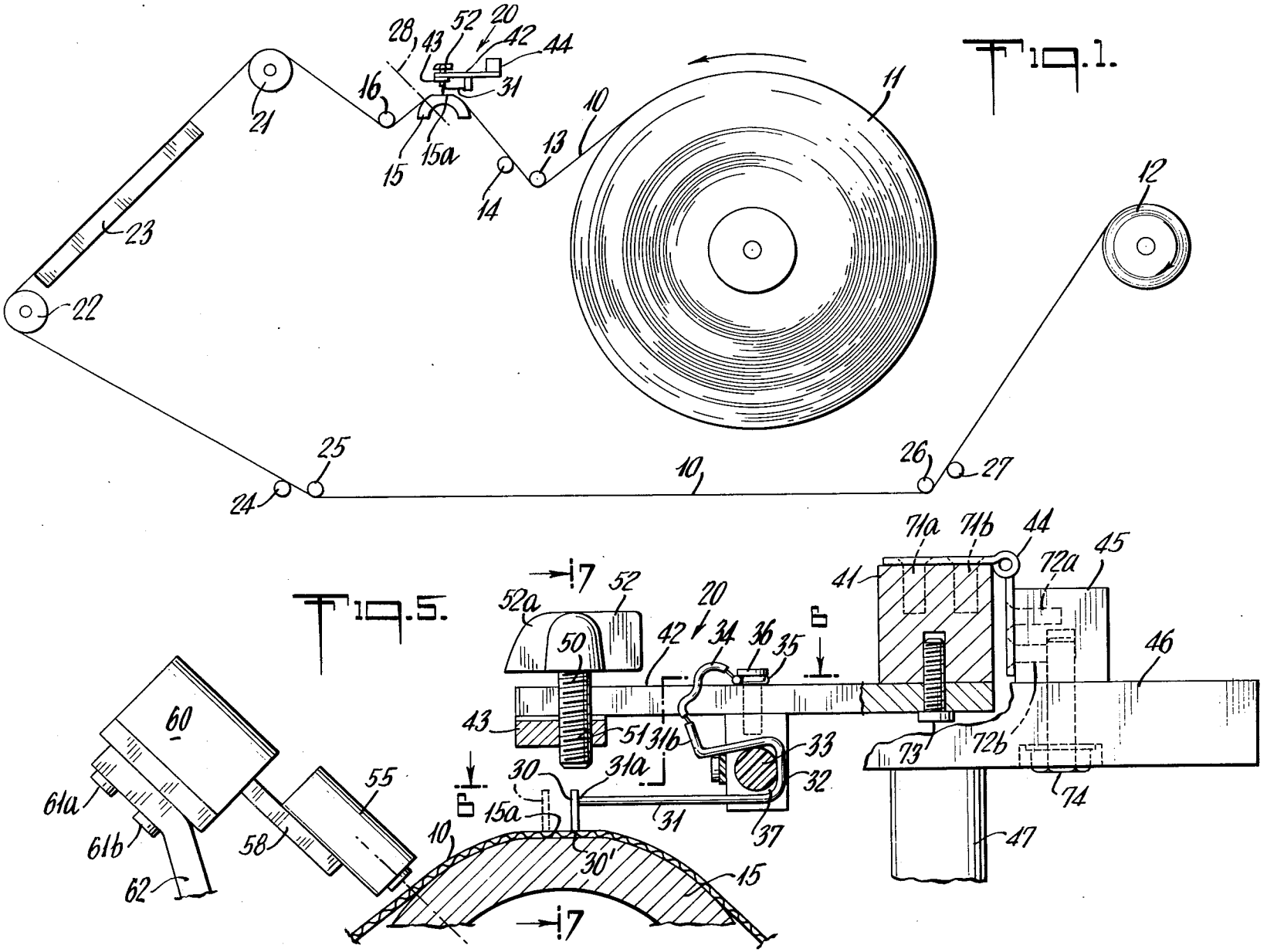
FIG. 1 is a diagrammatic side elevation of an apparatus for advancing a fabric web in combination with a bump detecting apparatus according to the invention.
FIG. 5 is a section taken on section line 5—5 of FIG. 2.

As seen in FIG. 1, fabric 10 is drawn off a supply roll 11 thereof by means of a take-up roll 12 which is driven clockwise as indicated by the arrow. The fabric passes in contact with guide and tension rolls 13 and 14, then into contact around part of the periphery of the generally semi-circular guide member 15 and therefrom into contact with the guide and tension roller 16. The detecting apparatus 20 of the invention is disposed above the guide member 15 for detecting any bumps on the fabric 10 as the fabric 10 passes over the guide member 15. From the guide and tension roller 16 the fabric passes over rollers 21 and 22 between which is interposed a back lighted screen 23 to provide good lighting for the operator to work on a flaw in the fabric which has been detected by the detecting apparatus 20. From the guide roller 22, the fabric 10 passes in contact with guide and tension rollers 24 and 25, therefrom into contact with guide and tension rollers 26 and 27 and, finally, is wound up on take-up roll 12. Center line 28 indicates the path of reciprocation of a marker which, as will be described hereinafter in greater detail, is utilized to mark the selvage of the fabric at a point in line with a bump on the fabric detected by the bump detector 20.

Figure 2:
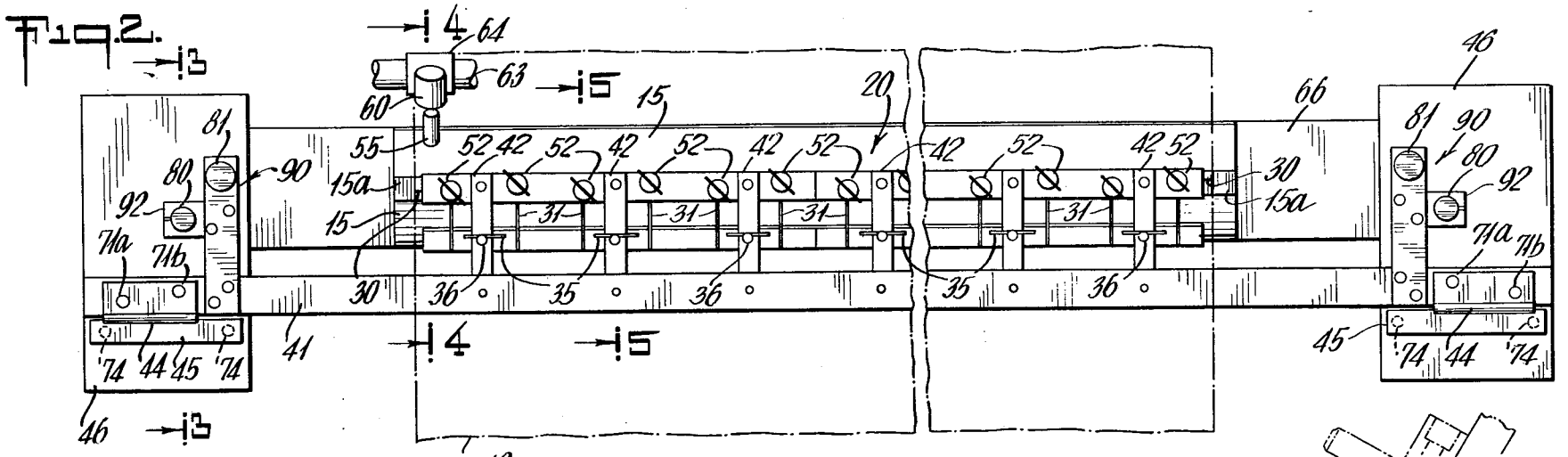
FIG. 2 is a plan view of the bump detecting apparatus.
Figure 3:
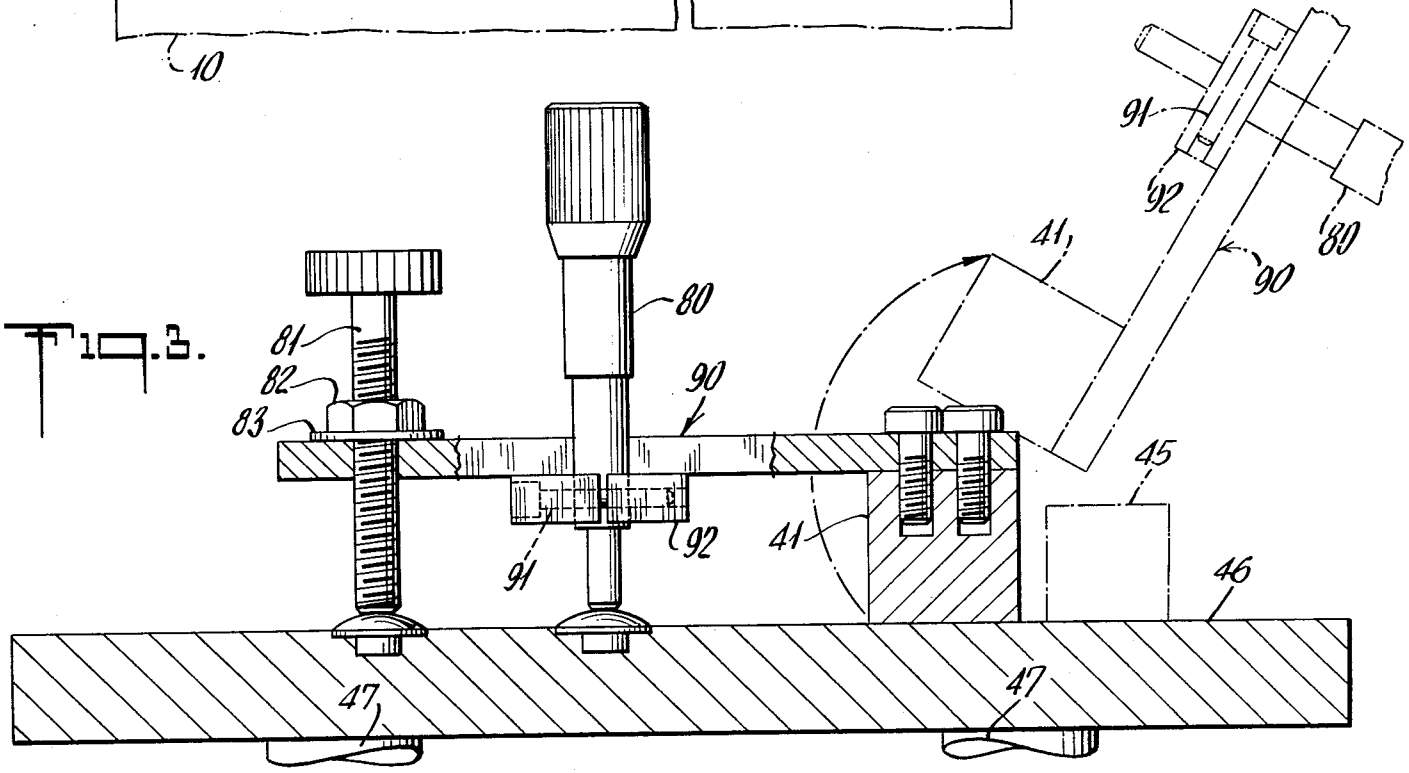
FIG. 3 is a section taken on section line 3—3 of FIG. 2.

FIGS. 2 and 3 illustrate the assembly for mounting and simultaneously adjusting a plurality of sensing blades according to the invention and will be described hereinafter in greater detail. The particular mounting of individual sensing blades and the relationship thereof to each other, along with the association thereof with the contact members, is more specifically illustrated in FIGS. 5, 6, 7, and 8. In addition, FIG. 4, along with FIG. 5, more specifically shows the marking device.

As seen from FIGS. 5–8, on the top of the generally cylindrical guide member 15 is milled a flat 15*a*. As the fabric 10 passes over the flat 15*a*, a plurality of sensing blades 30 ride on the fabric 10. A respective arm 31 is rigidly connected at one end 31*a* to its associated blade 30 and the other end portion thereof is formed into a hook 32 which partially surrounds and pivots on a substantially cylindrical bearing 33. More precisely, the surface of the bearing is generated by rotation of a symmetrical, slightly concave curve to keep the hooked portion 32 of the arm 31 substantially centered on the bearing. The end 31*b* of the arm 31 adjacent the hooked portion 32 is connected to bent wire terminal 35 which is locked in place by a screw 36. This structure is mounted on an assembly of support members 41, 42 and 43 which assembly is hingedly connected by means of hinges 44 to a support assembly including member 45, plate 46 and leg 47. The respective assemblies are, as illustrated, held together by screws.

Figure 8:
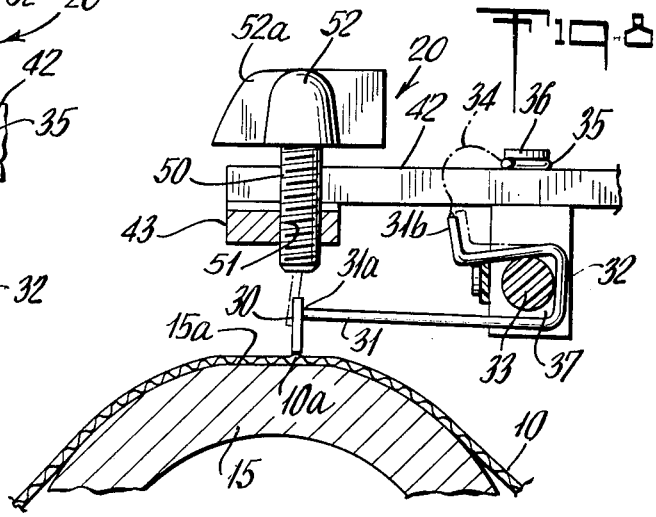
FIG. 8 is a side elevation, partly in section, of the detecting apparatus.

As can be seen in FIGS. 5 and 8, there is a clearance 37 between the hooked portion 32 of the arm 31 and the cylindrical bearing 33. This clearance permits the arm 31 to move slightly about an axis parallel to the arm so as to permit the lower edge 30' of the blade 30 which rides on the fabric 10 to seat itself on the fabric even if the line of contact of the edge 30' with the fabric 10 is not absolutely parallel to the axis of the shaft 33.

Figure 6:
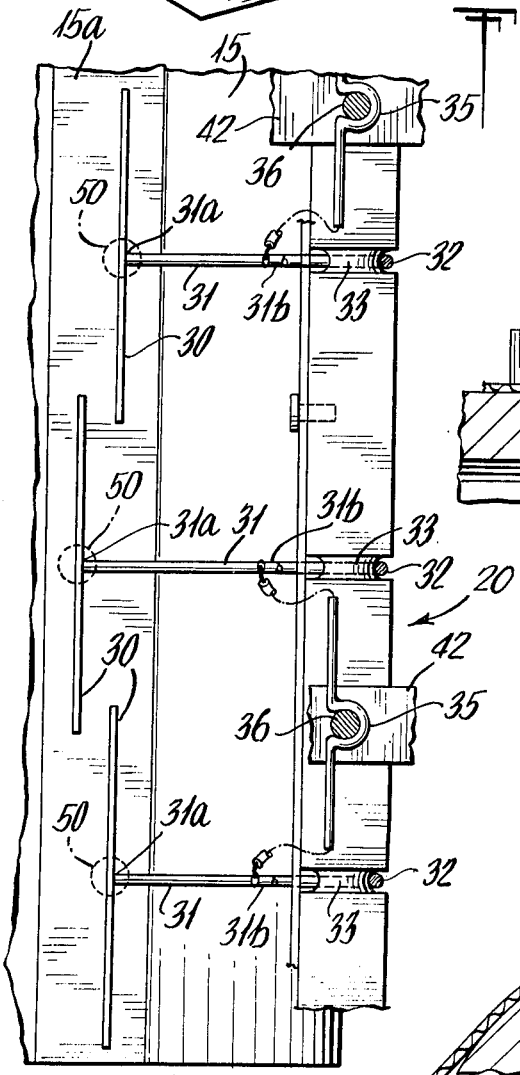
FIG. 6 is a fragmentary plan view taken on line 6—6 of FIG. 5.
Figure 7:
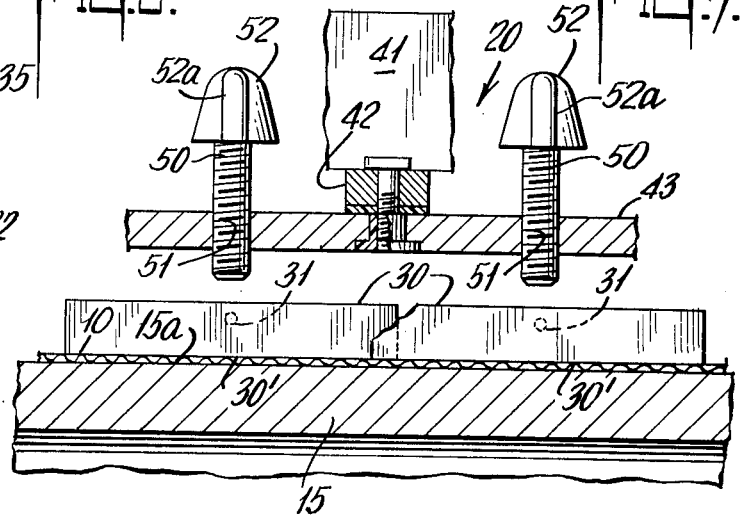
FIG. 7 is a section taken on line 7—7 of FIG. 5.

As seen in FIGS. 6 and 7, the plurality of blades 30 are mounted in staggered, slightly mutually overlapping relationship so that the entire width of the fabric is, with reliability, engaged by a sensing blade. In this connection, it is noted that the clearance 37 between the hooked portion 32 of each arm 31 and the respective bearing 33 is not so great as to permit the arm to move about an axis normal to the plane of the fabric 10 to an extent sufficient to cause adjacent blades to contact each other.

Mounted directly above each of the blades 30 is an externally threaded contact member 50 received in an internally threaded bore 51 in member 43. The top of the contact member 50 is provided with a knob 52 having a tapered portion 52*a* which permits one to readily determine roughly how large a fraction of a revolution one has turned the contact member 50.

Each blade 30 and the contact member 50 associated therewith constitutes a switch. When the blade 30 strikes a bump 10*a* on the fabric, as illustrated in FIG. 8, the blade 30 bounces upward, making contact with the bottom of the contact member 50. Through appropriate, conventional circuitry (not shown), this results in shutting down of the drive or other deactuable means (not shown) for the take-up roll 12. Also, a conventional, self-inking marker 55 is solenoid-actuated to stamp the fabric at the selvage thereof on a lateral line with the bump. In this regard, it is to be understood that the timing is such that the stopping of the machine is not instantaneous and the portion of the fabric containing the bump has advanced from the blade 30 to a point of lateral alignment with the marker 55 before the marker 55 stamps the selvage of the fabric. Essentially simultaneously with the foregoing, a conventional audible signal (not shown) is sounded, to alert the operator that a bump has been detected. A discrete, audible signal is sounded for each switch closing. Hence, even if there are a plurality of laterally aligned bumps, whereby a plurality of the switches are closed simultaneously, for each closed switch, a distinct audible signal will sound. Thus, while there will be only a single marking at the selvage of the fabric, the operator will be alerted to look for a plurality of bumps.

The fabric is then advanced to the back-lighted screen 23 where the operator works on removing the bump or bumps. The machine is then started up again and operation continues as before until another bump is detected.

Figure 4:
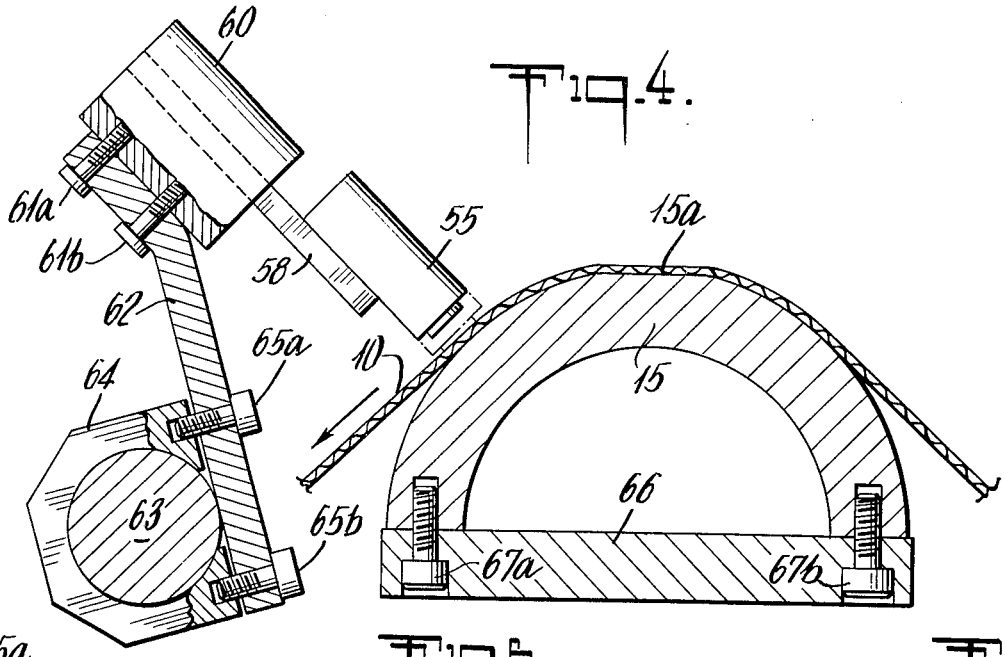
FIG. 4 is a section taken on section line 4—4 of FIG. 2.

Turning now to some of the more specific details of the construction of the bump detecting apparatus of the invention, particularly with reference to FIGS. 2–5, it is seen that the marker 55 is mounted on an arm 58 extending from the armature of a solenoid 60. The solenoid 60 is mounted by means of screws 61*a*, 61*b* on an arm 62 which is pivotally mounted on a shaft 63. A bearing 64, by means of which the pivotal mounting is effected, is attached to the arm 62 by means of screws 65*a* and 65*b*, as shown in FIG. 4. It can also be seen in FIG. 4 that the generally semi-circular guide 15, which has milled thereon a flat 15*a*, is fastened to a base plate 66 by means of screws 67*a* and 67*b*.

The pivotal mounting of the marker 55 makes it possible to swing the marker 55 out of proximity to the guide member 15 to facilitate start-up and shut-down. The same function is served, as shown in FIG. 3, by the pivotal mounting of the assembly supporting the blades 30 and contact members 50. The aforementioned hinge 44, which permits this movement, is fastened to member 41 by means of screws 71*a* and 71*b* and is fastened to member 45 by means of screws 72*a* and 72*b*. Member 41 is, in turn, fastened to member 42 by means of screw 73 and member 45 is, in turn fastened to member 46 by means of bolt 74.

With reference again to FIG. 3, it is seen that a micrometer 80 is provided to facilitate rapid adjustment of the entire bump detecting apparatus when the thickness of the web with which the apparatus is to be used is changed. It will readily be appreciated that the aforementioned hinging arrangement also serves in this capacity. One simply adjusts the screw 81 by first loosening the nut 82 which co-acts with the washer 83, to raise or lower the framework 90 of the assembly supporting the blades and contact members. One measures the distance by which the assembly is raised or lowered by means of the micrometer 80. For example, if one switches from a 2 mil fabric to a 5 mil fabric, one simply raises the assembly 90 by a distance of 3 mils, as determined by the micrometer 80. The micrometer 80 is locked in place in the framework 90 by means of a set screw 91 received in a block 92 integral with the assembly and through which the micrometer 80 passes.

While there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

What is claimed is:

1. Apparatus for detecting bumps in a soft, compressible web adapted to move relative to said apparatus, comprising at least one sensing member having an edge for riding on the web during said relative movement, means for supporting the sensing member with said edge oriented transversely of the direction of said movement, a contact member, means for supporting the contact member a distance above the sensing member greater than the height of the bumps to be detected, said contact member being contacted by said sensing member in response to the displacement of said sensing member by a bump on said moving web, the sensing member being of sufficiently low weight and so mounted that it will bear on the web sufficiently lightly so as not to substantially compress a bump on the web when engaged thereby and so as to bounce off a bump a distance sufficient to contact said contact member.

2. Apparatus according to claim 1, further comprising a plurality of said sensing members, means supporting the plurality of sensing members with the edge of each oriented transversely of the direction of said movement so that the edges will extend entirely across the web, each edge being so positioned as to overlap slightly each next adjacent edge, a plurality of said contact members, means for supporting each of said contact members a distance above a respective one of said sensing members greater than the height of the bumps to be detected, each of said contact members being contacted by the sensing member associated therewith in response to the displacement of said sensing member by a bump on said moving web, each of the sensing members being of sufficiently low weight and so mounted that it will bear on the web sufficiently lightly so as not to substantially compress a bump on the web when engaged thereby and so as to bounce off a bump a distance sufficient to contact said contact member.

3. Apparatus according to claim 1, in which the sensing member comprises a blade and the means for supporting the sensing member comprises a substantially cylindrical bearing arranged with the axis thereof parallel to said edge of said blade, an arm having one end rigidly connected to the blade intermediate the ends of the blade and the other end supported by the bearing so that the arm is free to move in a plane substantially normal to the plane of the web, said plane being substantially parallel to the direction of movement of the web, whereby the blade is free to bounce in response to engagement with a bump in the web.

4. Apparatus according to claim 2, in which each of the sensing members comprises a blade and the means for supporting each of the sensing members comprises a substantially cylindrical bearing arranged with the axis thereof parallel to the edge of the blade and, for each of the blades, a respective arm having one end rigidly connected to the blade intermediate the ends of the blade and the other end supported by the bearing so that the arm is free to move in a plane substantially normal to the plane of the web, said plane being substantially parallel to the direction of movement of the web, whereby the blades are free to bounce in response to engagement with a bump in the web.

5. Apparatus according to claim 3, in which said other end of the arm is hooked partially around the bearing with sufficient clearance to permit the arm to move slightly about an axis parallel to the arm, whereby the edge of the blade will seat itself on the web even when the line of contact of the edge of the blade with the surface of the web is not in a plane absolutely parallel to the axis of the shaft.

6. Apparatus according to claim 4, in which said other end of each of the arms is hooked partially around the bearing with sufficient clearance to permit the arm to move slightly about an axis parallel to the axis of the arm, whereby the edge of the blade will seat itself on the web even when the line of contact of the edge of the blade with the surface of the web is not in a plane absolutely parallel to the axis of the shaft, the clearance not being sufficient, however, to permit the arm to move about an axis normal to the plane of the web to an extent sufficient to cause the blade connected to the arm to contact a next adjacent blade.

7. Apparatus according to claim 5, in which the contact member comprises an externally threaded post and the apparatus further comprises a fixed member for supporting the post and having an internally threaded bore engaging the threads on the post whereby the post is axially adjustable by turning the post in the bore.

8. Apparatus according to claim 6, in which each of the contact members comprises an externally threaded post and the apparatus further comprises a fixed member for supporting the post and having an internally threaded bore engaging the threads on the post whereby the post is axially adjustable by turning the post in the bore.

9. Apparatus according to claim 7, in which the post and the blade comprise a switch in an electrical circuit, contact of the blade with the post closing the switch and permitting current to flow through the circuit.

10. Apparatus according to claim 8, in which each of the blades and the repective post mounted thereabove comprise a respective switch in an electrical circuit, contact of the blade with the post closing the switch and permitting current to flow through the circuit.

11. Apparatus according to claim 9, further comprising means for marking the web at an edge thereof at a location substantially in lateral alignment with a bump detected on the web, the marking means being operatively associated with the switch for actuation in response to closing of said switch.

12. Apparatus according to claim 10, further comprising means for marking the web at an edge thereof at a location substantially in lateral alignment with a bump detected on the web, the marking means being operatively associated with the switches for actuation in response to closing of any of said switches.

13. Apparatus according to claim 11, in combination with deactuatable means for moving the web, the means for moving the web being operatively associated with the switch for deactuation in response to closing of said switch.

14. Apparatus according to claim 12, in combination with deactuatable means for moving the web, the means for moving the web being operatively associated with the switches for deactuation in response to closing of any of said switches.

15. Apparatus according to claim 13, further comprising audible signal means, the audible signal means being operatively associated with the switch for actuation of the audible signal means in response to closing of said switch.

16. Apparatus according to claim 14, further comprising audible signal means, the audible signal means being operatively associated with the switches for actuation in response to closing of any of the switches and being adapted for emitting a discrete audible signal for each closing of a switch even when a plurality of switches are closed at the same time, whereby an operator of the apparatus is informed of the presence of a plurality of defects along the same transverse line on the web.

* * * * *